US011156423B2

(12) United States Patent
Winterseth et al.

(10) Patent No.: US 11,156,423 B2
(45) Date of Patent: Oct. 26, 2021

(54) COUPLING

(71) Applicant: A-TEC HOLDING AS, Son (NO)

(72) Inventors: Hallvard Winterseth, Saltnes (NO); Anders Eckhoff Johansen, Son (NO)

(73) Assignee: A-Tec Holding AS, Son (NO)

( * ) Notice: Subject to any disclaimer, the term of this patent is extended or adjusted under 35 U.S.C. 154(b) by 0 days.

(21) Appl. No.: 16/809,604

(22) Filed: Mar. 5, 2020

(65) Prior Publication Data

US 2020/0284542 A1 Sep. 10, 2020

(30) Foreign Application Priority Data

Mar. 8, 2019 (NO) ..... 20190328

(51) Int. Cl.
*F41A 21/32* (2006.01)
*F41A 21/34* (2006.01)

(52) U.S. Cl.
CPC ..... *F41A 21/325* (2013.01); *F41A 21/34* (2013.01)

(58) Field of Classification Search
CPC ..... F41A 21/325; F41A 21/34; F16B 21/00–205; F16L 37/08–20
See application file for complete search history.

(56) References Cited

U.S. PATENT DOCUMENTS 2,124,075 A * 7/1938 Moore ..... F41A 21/325 89/14.1
2,539,494 A 1/1951 Summerbell
2,852,983 A * 9/1958 Netzer ..... F41A 21/36 89/14.05
3,202,056 A * 8/1965 Seeberger ..... F41A 21/325 89/14.3
3,971,285 A * 7/1976 Ellis ..... F41A 21/36 89/14.3
4,920,679 A * 5/1990 Sarles ..... F41A 21/481 42/75.02
8,499,676 B1 8/2013 Moore et al.
10,234,230 B1 * 3/2019 Oglesby ..... F41A 21/325
2008/0156183 A1 * 7/2008 Brittingham ..... F41A 21/30 89/14.4
2014/0237881 A1 * 8/2014 Mack ..... F41A 21/325 42/90
2017/0205172 A1 * 7/2017 Curliss ..... F41A 21/16
2019/0226788 A1 * 7/2019 Johansen ..... F41A 21/325

* cited by examiner

*Primary Examiner* — Gabriel J. Klein
(74) *Attorney, Agent, or Firm* — Christian D. Abel

(57) ABSTRACT

The present invention relates to a coupling for quick and easy attachment and detachment of a firearm accessory to a muzzle of a firearm, the coupling including a female member and a male member, where the female member is provided with a throughgoing bore and further is provided with a number of successive threaded portions and unthreaded portions around a circumference of the through-going bore, wherein the male member around an outer circumference is provided with the same number of successive threaded portions and unthreaded portions as the female member, the female member further being provided with a groove arranged around an outer circumference of the female member and a through-going slit extending from the groove to an end of the female member, the male member being provided with a number of recesses arranged around an outer circumference of the male member, a resilient lock element being arranged in the groove.

13 Claims, 5 Drawing Sheets

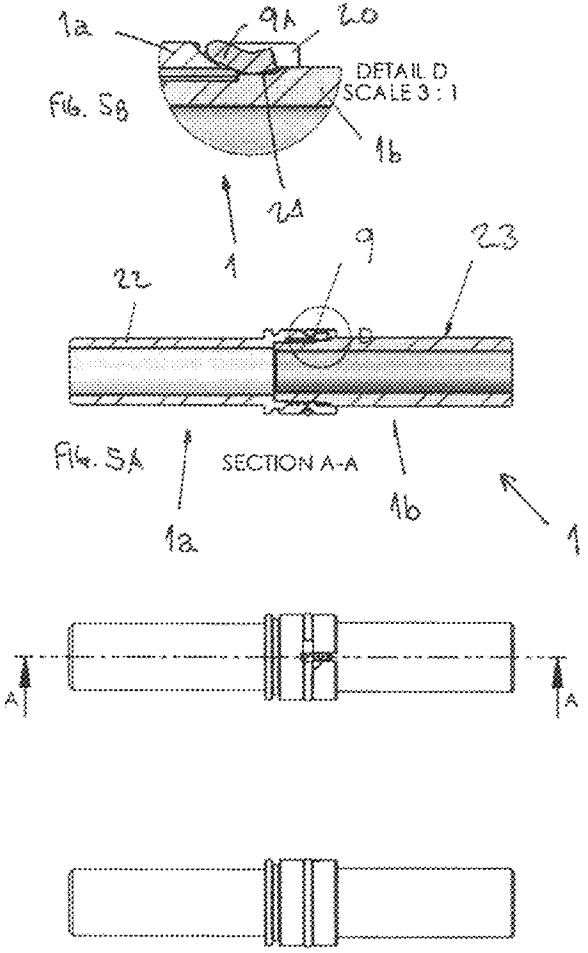
DETAIL D
SCALE 3 : 1
20
9A
1a
1b
2A
1
FIG. 5B
23
9
22
1b
1a
SECTION A-A
FIG. 5A
A
A
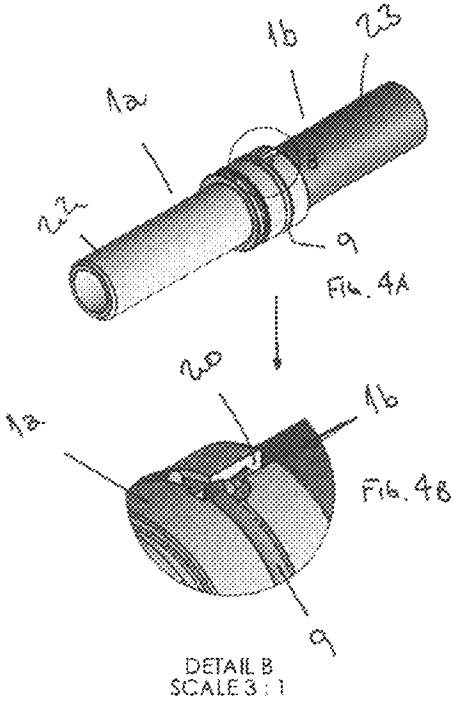
23
1b
9
1a
22
FIG. 4A
1b
FIG. 4B
9
20
DETAIL B
SCALE 3 : 1
1a

COUPLING

FIELD OF THE INVENTION

The present invention relates generally to firearms, accessories and accessory mounts for firearms, and particularly to muzzle end accessories and accessory mounts for firearms.

BACKGROUND OF THE INVENTION

The term "firearms" includes hand guns (including revolvers and pistols), long guns (including rifle and shotguns), automatic weapons (including machine guns, submachine guns and automatic rifles), and air-operated firearms.

It is often desirable to mount an accessory such as a flash suppressor or muzzle brake, silencer, grenade launcher, blank adapter, or the like, upon the muzzle or end of gun barrels. Such accessories are usually mounted upon an adapter which constitutes a coupling for attaching the accessory to the gun barrel.

Muzzle end mounted firearm accessories are available for attachment to the barrel of firearms to obtain various effects when the firearm is operated. Silencers are an example of such an accessory and include baffled chambers to slow the release of pressure from the barrel of the firearm. The slowed release of pressure reduces the audible report during firing. Flash hiders are another type of muzzle end accessory that include features to mix unburnt gunpowder and air in a manner that reduces the overall brightness of a flash that may occur during firing. Generally speaking, silencers and flash hiders may be mounted to the muzzle end of a firearm barrel in different rotational orientations without affecting the operation of the accessory.

Some muzzle end mounted accessories are designed for mounting to a firearm barrel in one or more particular rotational orientations to accomplish a desired effect. Muzzle brakes redirect a portion of combustion gases sideways or rearward, with respect to the firing direction, as the gases escape from a barrel when a shot is fired.

As the gases are redirected, the firearm is pushed forward in a manner that counteracts recoil of the firearm. Muzzle brakes are typically mounted to a firearm barrel in a particular rotational orientation, so as to prevent gases from being redirected upward into the line of sight of the firearm operator. The manner of rotationally orienting a muzzle end accessory on the barrel is often referred to as timing the accessory to the barrel.

Compensators are another type of muzzle end accessory that is timed to one or more particular rotational orientations when mounted to a firearm barrel. Compensators redirect the flow of gasses that escape from a barrel during firing in an overall upward direction. The resulting force that acts against the firearm counteracts other forces that urge the muzzle end of a rifle upward during firing.

It is known how to utilize firearm accessory adapters which include an opening receiving the end of the gun barrel and lugs, wherein the adapter includes lug retaining recesses which align with and retain the lugs upon relative rotation of the adapter and the gun barrel occurring after the adapter has been fully axially positioned upon the gun barrel.

U.S. Pat. No. 4,893,426 A relates to a lugged coupling apparatus, where an internally threaded collar having internal lugs is slidably received on a shaft comprising corresponding external lugs and is threadedly engaged on a threaded member and when rotated will engage the lugs and draw the shaft and threaded member together to form a secure, accurately aligned mechanical coupling which may be disassembled by reversing the process. The collar need never to be completely removed from the threaded member to install or remove the shaft.

U.S. Pat. No. 5,433,133 A relates to a quick detachable gun barrel coupling member, where the front end of the coupling member has an internally threaded portion having a left-hand thread. The rear end of the coupling member has a plurality of circumferentially spaced notches that form finger members between them. The finger members have radially inwardly extending lug members. The coupling member is slidably received on the front end of the gun barrel of a firearm and has at least three radially extending lug members and when rotated the respective lug members will engage each other. When a firearm accessory is threaded into the front end of the coupling member, it will form a secure, accurately aligned mechanical coupling which may be disassembled by reversing the process.

US 2008/156183 A1 relates to an apparatus and method for easily, quickly and reliably attaching a noise suppressor or other auxiliary device to the muzzle end of a firearm barrel and for easily, quickly and reliably removing the noise suppressor or other auxiliary device there from through the novel ideal of providing two or more non-equal relieved areas of thread. My invention also provides an internal O-ring to provide friction between the muzzle adaptor and the thread mount of a noise suppressor or other auxiliary device.

US 2017/167816 A1 relates to a quick connect for a pistol suppressor includes a housing having a first end, a second end, and a central bore with an upper portion, a lower portion, and an internal shoulder separating the upper and lower portions. A piston is within the central bore of the housing. The piston includes a piston shoulder that creates an upper recess within a central bore of the piston. A ring having a locking profile is selectively connected to the second end of the piston between the housing and the piston and a spring is positioned around an exterior of the piston. A wave spring is positioned in the upper recess of the piston adjacent the piston shoulder and a washer. A cap with a central opening and an internal locking profile is connected to the piston with the wave spring biasing the washer towards the locking profile.

US 2017/241733 A1 relates to a system for attaching an accessory to a firearm, where the system includes a muzzle device configured for attachment to the muzzle end of the firearm, the muzzle device having a first coarse-threaded engagement means and one of an annular grooved surface and a grooved surface engagement mechanism, and an adapter device. The adapter device includes an adapter having a forward portion including an accessory engagement means for receiving the accessory and a rearward portion having a second coarse-threaded engagement means formed on an inner surface of the adapter, a biasing mechanism received on the rearward portion, and a retainer ring received on the rearward portion adjacent to the biasing mechanism, the retainer ring having the other of the annular grooved surface and the grooved surface engagement mechanism. The male coarse-threaded engagement means, and the female coarse-threaded engagement means cooperate to releasably secure the adapter device to the muzzle device.

U.S. Pat. No. 4,920,679 A relates to a firearm, where the firearm includes a barrel adapted for facile mounting on and removal from the breech of the weapon. As part of the breech, a barrel extension extends outwardly and terminates in a resistance surface. That resistance surface has a bore formed therein and extending inwardly therefrom, which bore has spaced around its periphery internal threads interrupted to form a plurality of thread segments separated from each other by threadless portions.

US 2008/156183 A1 relates to an apparatus and method for easily, quickly and reliably attaching a noise suppressor or other auxiliary device to the muzzle end of a firearm barrel and for easily, quickly and reliably removing the noise suppressor or other auxiliary device there from through the novel ideal of providing two or more non-equal relieved areas of thread.

BRIEF SUMMARY OF THE INVENTION

The use of a threaded lock member to maintain the lugs within the adapter lug retaining recesses requires several steps of operation to mount the adapter on the gun barrel. It cannot easily be accomplished with one hand, and the possibility of the adapter loosening on the barrel exists in the event the threaded lug locking member unloosens due to vibration occurring during firearm operation.

It is an object of the invention to provide a coupling for a firearm accessory which may quickly be mounted upon a muzzle of a firearm wherein only axial and rotative one hand movement is required to mount and lock the adapter on the muzzle of the firearm.

A further object of the invention is to provide a coupling which will not loosen unintentionally during operation and/or firing of the firearm.

These objects are achieved according to the invention by means of the features indicated in the following independent claim, where further features of the invention will become apparent from the dependent claims and the description below.

The present invention relates to a coupling for quick and easy attachment and detachment of a firearm accessory to a muzzle of the firearm, where the firearm accessory, for instance, may be a flash suppressor or muzzle brake, a silencer, a grenade launcher, blank adapter, or the like, and where the coupling is provided with means to prevent unintentional loosening of the coupling.

The coupling for quick and easy attachment and detachment of a firearm accessory to a firearm according to the present invention comprises a female member and a male member, where the female member is provided with a throughgoing bore and further is provided with a number of successive threaded portions and unthreaded portions around a circumference of the throughgoing bore, where the male member around an outer circumference is provided with the same number of successive threaded portions and unthreaded portions as the female member, the female member further being provided with a groove arranged around an outer circumference of the female member and a through-going slit extending from the groove to an end of the female member, the male member being provided with a number of recesses arranged around an outer circumference of the male member, a resilient lock element being arranged in the groove.

Each of the female and male members must be provided with the same numbers of threaded and unthreaded portions, and where the number of threaded portions (and thereby also the number of unthreaded portions) may be two or more. In one embodiment, each of the female and male members may be provided with three threaded portions and three unthreaded portions, where the threaded portions may be arranged 60 degrees displaced relative each other.

If the female member and the male member are provided with two threaded portions, the threaded portions may be arranged 90 degrees displaced relative each other. If the female member and the male member are provided with four threaded portions, the threaded portions may be arranged 45 degrees displaced relative each other.

Each of the threaded portions and each of the unthreaded portions of the female member may then then be equally displaced relative each other, and each of the threaded portions and each of the unthreaded portions of the male member may then be equally displaced relative each other.

The threaded and unthreaded portions of the female and male members may be provided to have the same length around the circumference of the female and male members, but it could also be envisaged that the threaded portions and unthreaded portions of the female and male members could be provided to have different lengths.

Threads in the threaded portions of the female and male members are manufactured in such a way that each thread in one threaded portion of the female and male members will have, relative a given plane, the same entry and the same exit as a corresponding thread in each of the remaining threaded portions of the female and male members. This configuration will allow a locking of the coupling no matter how the female and male members are oriented relative each other, as the threads of each threaded portions of the male member will correspond to the threads of any of the threaded portions of the female member.

One end of the resilient lock element may, in order to provide a spring or elastic effect, be bent to form a protruding part out from the resilient lock element.

According to one aspect of the present invention, the protruding part of the resilient lock element may be provided with a bead or a bulge or the like, where this bead or bulge will be arranged to be in contact with the male member when the female and male members of the coupling are to be connected.

Each of the recesses arranged around the outer circumference of the male member may, in one embodiment, be formed with sloping walls and an even or plane bottom. However, it could also be envisaged that the recesses could have a cross-section in form of a U, a V or the like.

Furthermore, the recesses could be provided to have same or different cross-sectional forms.

According to one aspect of the present invention the recesses may be spaced apart equally around the outer circumference of the male member. However, it could also be envisaged that the recesses could be grouped in pairs, where the recesses in a pair could be arranged to have a different distance between them than a distance between two following pairs of recesses.

When the resilient lock element is arranged and accommodated in the groove arranged around the outer circumference of the female member, the protruding part of the resilient lock element will be arranged and accommodated in the through-going slit provided in the female member. The protruding part will, due to its form, also extend a distance into the through-going bore of the female member. When the male member of the coupling is inserted into the female member of the coupling, the protruding part of the resilient lock element will be received in one of the recesses arranged around the outer circumference of the male member. In this position, the threaded portions of the male member are aligned or in level with the unthreaded portions of the female members, and the unthreaded portions of the male member are aligned or in level with the threaded portions of the female member. When the male member is rotated relative the female member in order to lock the coupling, a certain force must be applied to bring the protruding part of the resilient lock element out of the recess it is accommodated in, whereafter the male member is rotated such that the threaded portions of the male member are brought into contact with the threaded portions of the female member. When the male member is rotated a certain distance, the threaded portions of the male member are aligned or in level with the threaded portions of the female member, where this movement at the same time has moved or transferred the protruding part of the resilient lock element to a following recess provided in the male member, whereby the protruding part of the resilient lock element will snap into this recess. When the protruding part of the resilient lock element has snapped into this recess, the female and male members are locked together and cannot be released unintentionally.

In one exemplary embodiment, the coupling member according to the present invention may be used to attach a silencer directly to the muzzle of the firearm, or indirectly via a flash suppressor or muzzle brake. If the silencer is attached directly to the muzzle of the firearm, then the muzzle of the firearm is formed to be and to function as the male member, while the silencer is formed to be and to function as the female member. Alternatively, an adapter may be connected to the silencer, the adapter then being formed to be and to function as the female member, whereby the adapter is provided with a threaded portion around its outer circumference in order to be connected to the silencer through a corresponding internal threaded portion provided in the silencer.

If the silencer is attached indirectly to the muzzle of the firearm through the flash suppressor, then the silencer is formed to be and to function as the female member, while the flash suppressor is formed to be and to function as the male member. The flash suppressor is then provided with a threaded portion around an inner circumference of a throughgoing bore in order to be connected to the muzzle of the firearm.

In another exemplary embodiment, the coupling according to the present invention may be used to attach a flash suppressor to the muzzle of the firearm, whereby the muzzle of the firearm is formed to be and to function as the male member, while the flash suppressor is formed to be and to function as the female member.

As flash suppressors and silencers may be designed and formed in many ways known to a person skilled in the art, these are not described any further herein, but a person skilled in the art would know how these should be formed to obtain their function as a flash suppressor or silencer.

When the female member and the male member of the coupling according to the present invention are to be attached to each other, the male member is inserted into the female member in such a way that the unthreaded portions of the male member are aligned with the threaded portions of the female member, whereafter the male member is rotated anticlockwise in order to bring the threaded portions of the male member into contact with the threaded portions of the female member, thereby locking the female member and the male member of the coupling member. When the female member and the male member of the coupling member are to be detached, the male member is rotated clockwise, such that the threaded portions of the male member are brought out of contact with the threaded portions of the female member. When the male member is rotated a certain distance, the unthreaded portions of the male member are aligned with the threaded portions of the female member, whereby the male member can be removed from the female member.

The female member of the coupling member may be provided with at least one abutment shoulder around the circumference of the throughgoing bore, where the at least one abutment shoulder will cooperate with at least one abutment shoulder provided around an outer circumference of the male member. The abutment shoulders will then restrict the distance the male member can be moved along a longitudinal direction of the female member and further provide a correct adjustment or setting of the threaded portions of the female and male members, such that male member can be rotated without further adjustment. The abutment shoulders of the female and male members will also form a tight connection in the coupling device when the female and male members are locked together.

The at least one abutment shoulder of the female member may be arranged to be perpendicular to an axis extending in a longitudinal direction of the female member, or the at least one abutment shoulder may be arranged to form an angle relative said axis extending in a longitudinal direction of the female member. If, for instance, each of the female and male members is provided with two abutment shoulders, one abutment shoulder may be arranged at the beginning and at the end of the threaded portions, both abutment shoulders may be arranged to be perpendicular to the axis, both abutment shoulders may be arranged to form the same or different angles relative the axis, or one abutment shoulder may be arranged to be perpendicular to the axis while the other abutment shoulder may be arranged to form an angle relative the axis.

In one embodiment, the female member may be provided with an external threaded portion, for instance when the female member is an adapter that is intended to be connected to a silencer, where the silencer is provided with an internal threaded portion on an inside of the throughgoing bore.

The female member may have a circular cross-section, but it could be envisaged that the female member could have other cross-sections, such as polygonal cross-section, an oval cross-section or the like.

In one embodiment, the male member may be provided with a throughgoing bore.

In one embodiment, the male member may be provided with an internal threaded portion.

The male member may have a circular cross-section, but it could be envisaged that the male member could have other cross-sections, such as polygonal cross-section, an oval cross-section or the like. In one embodiment the male member may, over at least a part of its longitudinal length, be provided with a substantially triangular form, where the acute angles of the triangle is rounded.

Further objects, structural embodiments and advantages of the present invention will be clearly shown in the following detailed description, the attached drawings and the following claims.

BRIEF DESCRIPTION OF THE DRAWINGS

The invention will now be explained with reference to the attached figures in which;

FIGS. 4A-4B show the coupling according FIG. 3 assembled, where FIG. 4A shows the female and male member connected and locked to each other, while FIG. 4B shows in greater detail a resilient lock element of the coupling, FIGS. 5A-5B show a cross-sectional view of the coupling according to FIGS. 4A-4B, where FIG. 5A shows the female and male member connected and locked to each other, while FIG. 5B shows in greater detail the resilient spring element of the coupling.

DETAILED DESCRIPTION OF THE INVENTION

Figure 1:
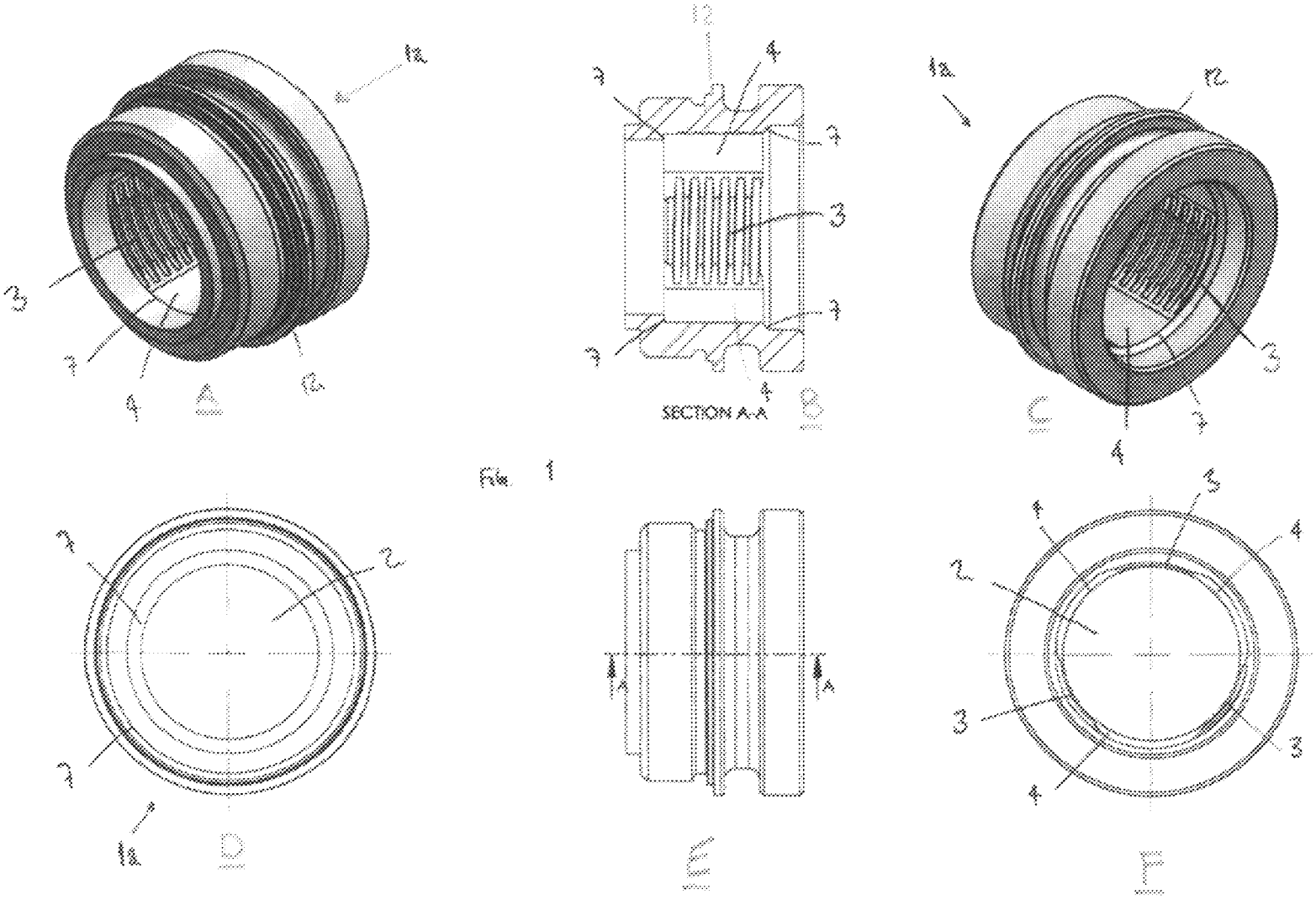
FIGS. 1A-F show one exemplary embodiment of a female member of the coupling according to the present invention, seen from front, from behind, in a cross-section and in perspective views.

FIG. 1 shows a female member 1*a* of the coupling 1 according to the present invention, where the female member 1*a* is provided with a throughgoing bore 2. A diameter of the throughgoing bore 2 will vary over the longitudinal length of the female member 1*a*, as will be described below.

Three threaded portions 3 and three unthreaded portions 4 are provided around a circumference of the throughgoing bore 2, where the threaded portions 3 and the unthreaded portions 4 are arranged in turns, i.e. a threaded portion 3 is followed by an unthreaded portion 4 and an unthreaded portion 4 is followed by a threaded portion 3. Each of the threaded portions 3 and each of the unthreaded portions 4 are displaced 60 degrees relative each other.

Furthermore, the female member 1*a* is provided with two abutment shoulders 7 extending around the whole circumference of the throughgoing bore 2, where the first abutment shoulder 7 is arranged in front of the threaded and unthreaded portions 3, 4 and the second abutment shoulder 7 is arranged behind the threaded and unthreaded portions 3, 4. The first abutment shoulder 7 defines a first diameter within the throughgoing bore 2, where the first diameter will extend to the second abutment shoulder 7, where the second abutment shoulder 7 will define a second diameter within the throughgoing bore 2. The area of the first diameter is formed to receive and accommodate a part of a male member 1*b* of the coupling 1.

Figure 2:
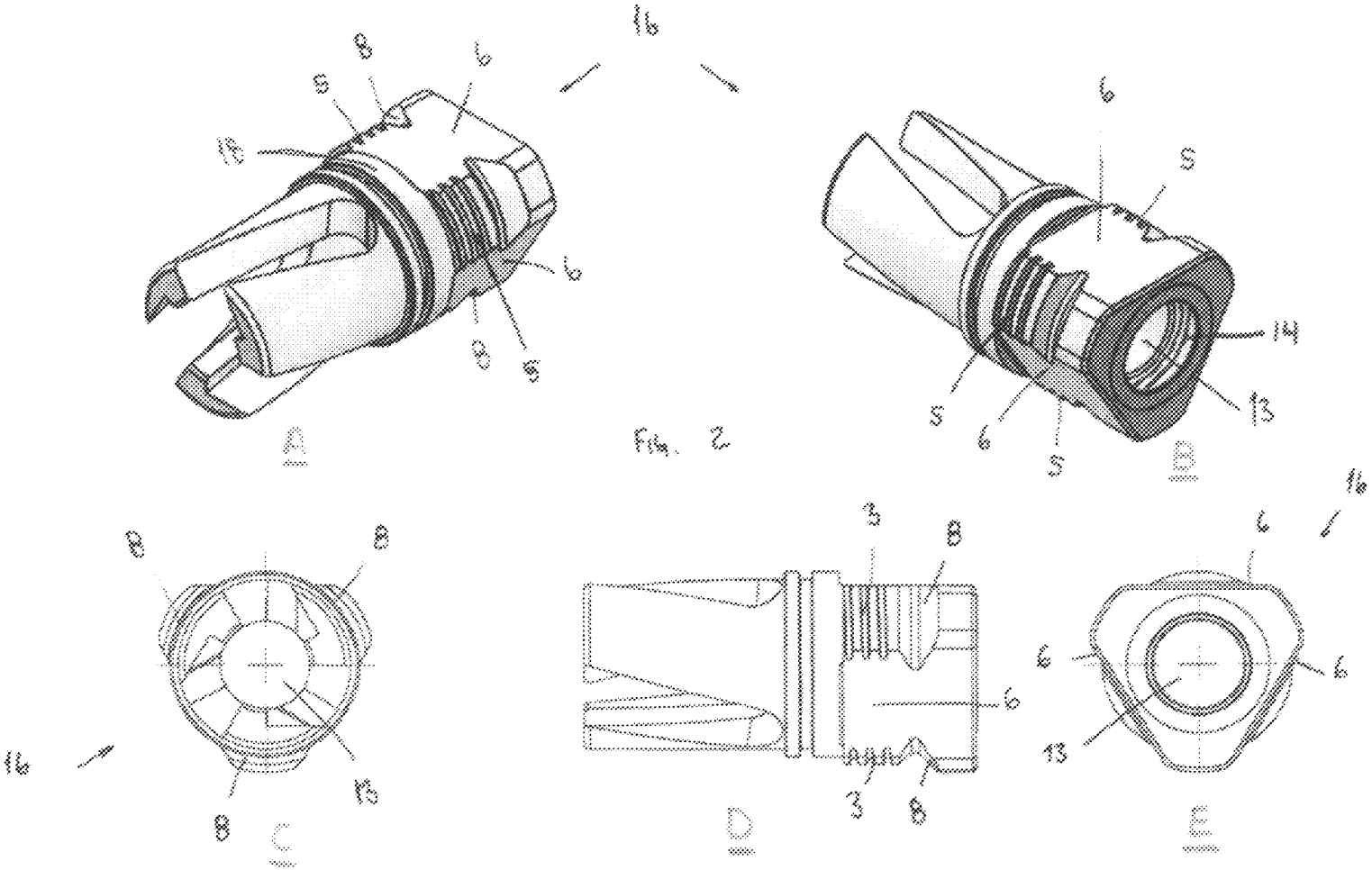
FIGS. 2A-E show one exemplary embodiment of a male member of the coupling according to the present invention, seen from front, from behind, in a cross-section and in perspective views.

FIG. 2 shows a male member 1*b* of the coupling 1 according to the present invention, where the male member 1*b* is provided with a throughgoing bore 13.

In a similar way as the female member 1*a*, the male member 1*b* is also provided with three threaded portions 5 and three unthreaded portions 6 around its circumference, where the threaded portions 5 and unthreaded portions 6 are arranged successively each other.

The male member 1*b* is also provided with a first abutment shoulder 8 and a second abutment shoulder 18.

Threads in the threaded portions 3, 5 of the female and male members 1*a*, 1*b* are manufactured in such a way that each thread in one threaded portion 3, 5 of the female and male members 1*a*, 1*b* will have the same entry and the same exit as a corresponding thread in each of the remaining threaded portions of the female and male members. This configuration will allow a locking of the coupling no matter how the female and male members are oriented relative each other, as the threads of each threaded portions of the male member will correspond to the threads of any of the threaded portions of the female member.

Figure 3:
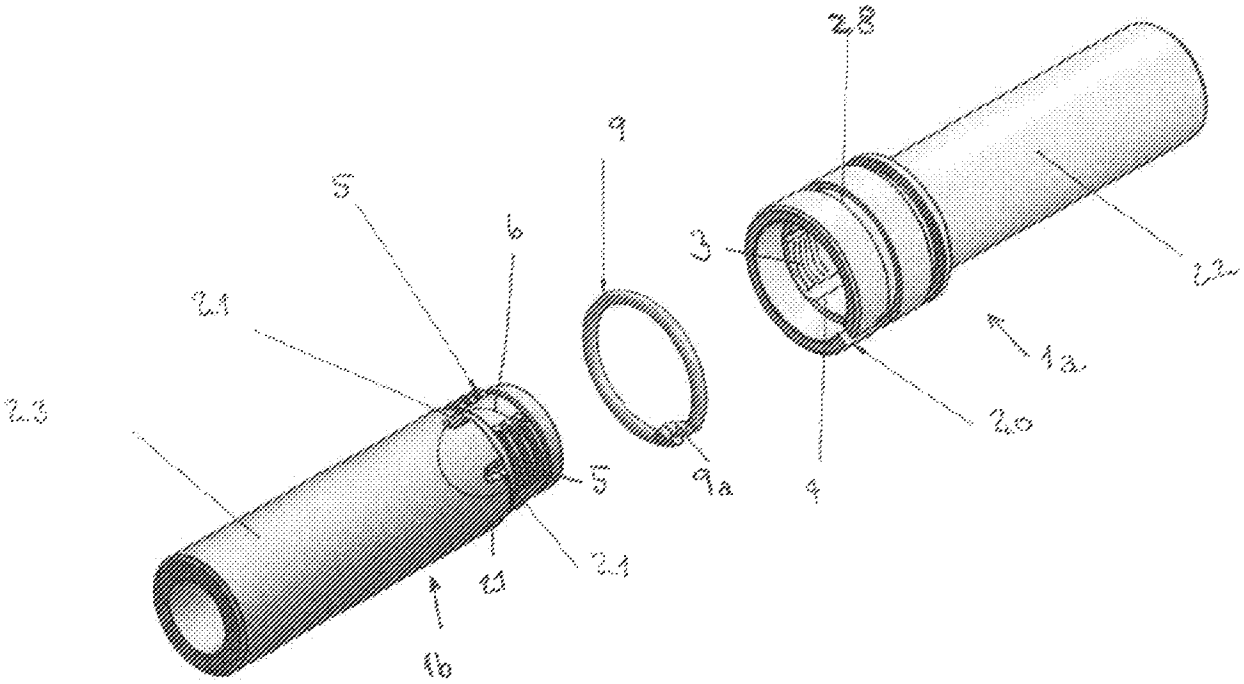
FIG. 3 shows an alternative and exemplary embodiment of a female and a male member of the coupling according to FIGS. 1 and 2, shown in an exploded view.

FIG. 3 shows an alternative and exemplary embodiment of the coupling 1 according to the present invention, where the coupling 1 is provided with a safety arrangement to impede or prevent an unintentional releasing of the female and male members 1*a*, 1*b* when the coupling 1 has been assembled and connected to a firearm.

The female member 1*a* is provided with a throughgoing bore 2. A diameter of the throughgoing bore 2 will vary over the longitudinal length of the female member 1*a*, as will be described below.

Three threaded portions 3 and three unthreaded portions 4 are provided around a circumference of the throughgoing bore 2, where the threaded portions 3 and the unthreaded portions 4 are arranged in turns, i.e. a threaded portion 3 is followed by an unthreaded portion 4 and an unthreaded portion 4 is followed by a threaded portion 3. Each of the threaded portions 3 and each of the unthreaded portions 4 are displaced 60 degrees relative each other.

Furthermore, the female member 1*a* is provided with two abutment shoulders 7 extending around the whole circumference of the throughgoing bore 2, where the first abutment shoulder 7 is arranged in front of the threaded and unthreaded portions 3, 4 and the second abutment shoulder is arranged behind the threaded and unthreaded portions 3, 4. The first abutment shoulder 7 defines a first diameter within the throughgoing bore 2, where the first diameter will extend to the second abutment shoulder 7, where the second abutment shoulder 7 will define a second diameter within the throughgoing bore 2. The area of the first diameter is formed to receive and accommodate a part of a male member 1*b* of the coupling member 1.

The male member 1*b* is provided with a throughgoing bore 13. In one embodiment, the throughgoing bore may be provided with an internal threaded area 14.

In a similar way as the female member 1*a*, the male member 1*b* is also provided with three threaded portions 5 and three unthreaded portions 6 around its circumference, where the threaded portions 5 and unthreaded portions 6 are arranged successively each other.

The male member 1*b* is also provided with a first abutment shoulder 8 and a second abutment shoulder 18.

Furthermore, as shown in FIG. 3, the female member 1*a* is provided with a groove 28 extending around an outer periphery of the female member 1*a*, where the groove 28 is adapted to receive and accommodate a resilient lock element 9. The female member 1*a* is also provided with a through-going slit 20, where the through-going slit 20 extends in a longitudinal direction of the female member 1*a*, from from one end of the female member 1*a* and to the groove 28, such that the groove 28 is in contact with the through-going slit 20.

One end of the resilient lock element 9 is, in order to provide a spring or elastic effect, bent to form a protruding part 9*a* out from the resilient lock element 9. The protruding part 9*a* of the resilient lock element 9 is provided with a bead or bulge, where this bead or bulge is arranged to be in contact with the male member 1*b* when the female and male members 1*a*, 1*b* of the coupling 1 are to be connected to each other.

The male member 1*b* of the coupling 1 is provided with a number of recesses 21 around an outer circumference of the male member 1*b*, where the recesses 21 in this embodiment are spaced with an equal distance between them around the circumference of the male member 1*b*.

The recesses 21 will have a cross-sectional form that on one hand will keep the protruding part 9*a* of the resilient lock element 9 in the recess 21 in order to provide a secure locking of the female and male members 1*a*, 1*b* of the coupling 1, but on the other hand also ease the move of the protruding part 9*a* out from the recess 21 when a certain predetermined pressure is applied to the coupling 1 in order to detach the female and male members 1*a*, 1*b* from each other.

Figure 7:
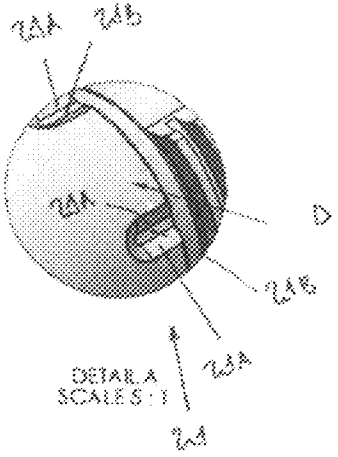
FIG. 7 shows in greater detail recesses arranged around an outer periphery of the male member of the coupling.

One embodiment of the recesses 21 can be seen in FIG. 7, where it can be seen that each recess 21 in this embodiment is formed with sloping walls 21A and an even or plane bottom 21B.

Furthermore, the recesses 21 of the male member 1*b* are designed or manufactured to have an "open" end towards the side facing the female member 1*a*, such that the protruding part 9*a* of the resilient lock ring 9 can be inserted into the recess 21 through the open end.

In this embodiment the female member 1*a* is provided with an adaptor 22 for a silencer (not shown) or the like, while the male member 1*b* is provided with an adaptor 23 for a barrel.

FIG. 4A shows the coupling 1 according to FIG. 3 in an assembled state, while FIG. 4B shows in greater detail the resilient lock member 9 arranged in the groove 28 of the female member 1*a*, where it can be seen that the protruding part 9*a* of the protruding part 9 is arranged in the through-going slit 20 provided in the female member 1*a* and where the protruding part 9*a* of the resilient lock member 9 extends through the through-going slit 20 to be accommodated in one recess 21 provided in the male member 1*b*.

This can also be seen in FIGS. 5A-5B, the FIGS. 5A-5B showing a cross-sectional view of the assembled and locked coupling 1, where the protruding part 9*a* of the resilient lock member 9 is arranged in the through-going slit 20 of the female member 1*a*, and where the protruding part 9*a* of the resilient lock member 9 extends through the through-going slit 20 and into the through-going bore 2 of the female member 1*a*, in order to be able to snap into one recess 21 provided in the male member 1*b*.

When the resilient lock element 9 is arranged and accommodated in the groove 28 arranged around the outer circumference of the female member 1*a*, the protruding part 9*a* of the resilient lock element 9 will be arranged and accommodated in the through-going slit 20 provided in the female member 1*a*. The protruding part 9*a* will, due to its form, also extend a distance into the through-going bore 2 of the female member 1*a*. When the male member 1*b* of the coupling 1 is inserted into the female member 1*a* of the coupling 1, the protruding part 9*a* of the resilient lock element 9 will be received in one of the recesses 21 arranged around the outer circumference of the male member 1*b*. In this position, the threaded portions 5 of the male member 1*b* are in level with the unthreaded portions 4 of the female member 1*a*, and the unthreaded portions 6 of the male member 1*b* are in level with the threaded portions 3 of the female member 1*a*. When the male member 1*b* is rotated relative the female member 1*a* in order to lock the coupling 1, a certain force must be applied to bring the protruding part 9*a* of the resilient lock element 9 out of the recess 21 it is accommodated in, whereafter the male member 1*b* is rotated such that the threaded portions 5 of the male member 1*b* are brought into contact with the threaded portions 3 of the female member 1*a*. When the male member 1*b* is rotated a certain distance, the threaded portions 5 of the male member 1*b* are in level with the threaded portions 3 of the female member 1*a*, where this movement at the same time has moved or transferred the protruding part 9*a* of the resilient lock element 9 to the following recess 21 of the male member 1*b*, whereby the protruding part 9*a* of the resilient lock element 9 will snap into this recess 21. When the protruding part 9*a* of the resilient lock element 9 has snapped into this recess 21, the female and male members 1*a*, 1*b* are locked together and cannot be released unintentionally.

Figure 6:
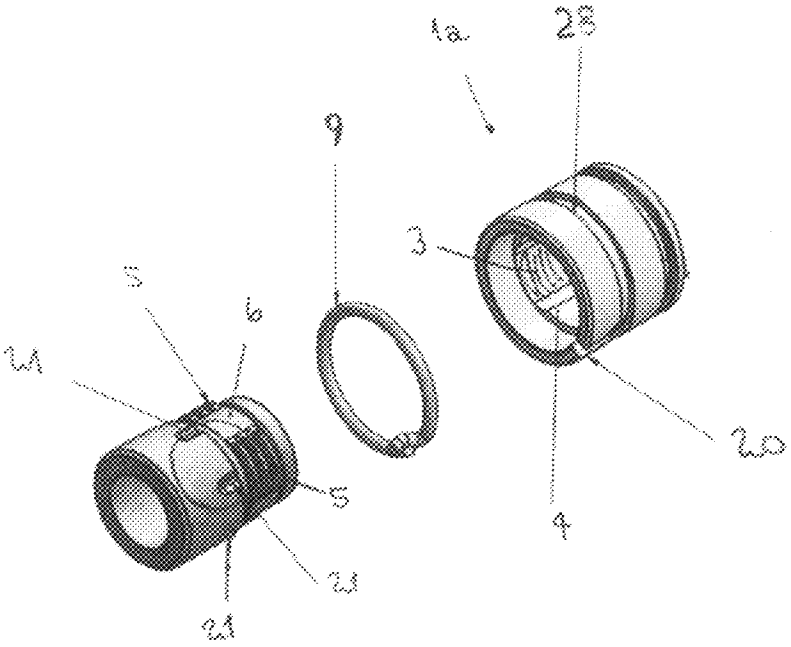
FIG. 6 shows another and exemplary embodiment of the female and male member of the coupling according to FIG. 3, in an exploded view.

FIG. 6 show an alternative embodiment of the female and male members 1*a*, 1*b* according to FIG. 3 but where the female and male members 1*a*, 1*b* in this embodiment are not provided with adaptors. The female and male members 1*a*, 1*b* will otherwise be made or manufactured as described according to FIG. 3.

The coupling 1 according to the present invention may, for instance, be used to attach a silencer to a muzzle (not shown) of a firearm (not shown). The silencer can then be attached to the firearm either directly, or indirectly through use of a flash suppressor.

If the silencer is attached directly to the firearm, the muzzle of the firearm is designed to be the male part 1*b*, while the female part 1*a* is integrated in the silencer, whereby the silencer can be connected directly to the firearm.

It should also be understood that the female member 1*a* could be provided as a separate adapter, where the adapter is designed to be connected to the silencer. In this case the female member 1*a*, in the form of an adapter, must be provided with an external threaded area 12 and the silencer must be provided with a corresponding internal threaded area, such that the female member la and the silencer could be connected to each other.

If the silencer is attached indirectly to the firearm through a flash suppressor, the flash suppressor is designed to be the male member 1*b*, while the female member 1*a* is either integrated in the silencer, or the female member 1*a* is designed to be a separate adapter. If the female member 1*a* is a separate adapter, the adapter must be provided with an external threaded area 12 and the silencer must be provided with a corresponding internal threaded area, such that the female member 1*a* and the silencer could be connected to each other.

Similarly, the flash suppressor must be provided with an internal threaded area 14 and the muzzle of the firearm must be provided with a corresponding external threaded area, such that the flash suppressor could be connected to the muzzle of the firearm.

The coupling 1 according to the present invention may also, for instance, be used to attach a flash suppressor to a muzzle of a firearm. The flash suppressor can then be attached to the firearm either directly, or indirectly through use of a female member 1*a* in the form of a separate adapter.

If the flash suppressor is attached directly to the firearm, the muzzle of the firearm is designed to be the male part 1*b*, while the female part 1*a* is integrated in the flash suppressor, whereby the flash suppressor can be connected directly to the firearm.

If the flash suppressor is attached indirectly to the firearm through a female member 1*a* in the form of an adapter, the adapter must be provided with an external threaded area and the flash suppressor must be provided with a corresponding internal threaded area, such that the female member 1*a* and the flash suppressor can be connected to each other.

When the female member 1*a* and the male member 1*b* of the coupling 1 according to the present invention are to be attached to each other, the female member 1*a* must be connected to a firearm accessory if the female member 1*a* is not integrated in the firearm accessory. Thereafter the male member 1*b* is inserted into the female member 1*a* in such a way that the unthreaded portions 6 of the male member 1*b* are aligned with the threaded portions 3 of the female member 1*a*, whereafter the male member 1*b* is rotated anticlockwise in order to bring the threaded portions 5 of the male member 1*b* into contact with the threaded portions 3 of the female member 1*a*, thereby locking the female member 1*a* and the male member 1*b* of the coupling member 1. If the female member 1*a* is provided with the resilient lock element 9, an additional force must be applied in order to overcome the effect of the protruding part 9*a* provided with a bead. When the female member 1*a* and the male member 1*b* of the coupling 1 are to be detached from each other, the male member 1*b* is rotated clockwise, such that the threaded portions 5 of the male member 1*b* are brought out of contact with the threaded portions 3 of the female member 1*a*. When the male member 1*b* is rotated a certain distance, the unthreaded portions 6 of the male member 1*b* are aligned with the threaded portions 3 of the female member 1*a*, whereby the male member 1*b* can be removed from the female member 1*a*.

The present invention has now been explained with reference to embodiments, but a person skilled in the art will appreciate that changes and modifications will be able to be made to these embodiments which lie within the scope of the invention as defined in the following claims.

The invention claimed is:

1. A coupling for attachment and detachment of a firearm accessory to a muzzle of a firearm, the coupling comprising a female member and a male member, the female member being provided with a throughgoing bore and further being provided with a number of successive threaded portions and unthreaded portions around a circumference of the throughgoing bore, wherein the male member around an outer circumference being provided with the same number of successive threaded portions and unthreaded portions as the female member, wherein the female member further is provided with a groove arranged around an outer circumference of the female member and a through-going slit extending from the groove to an end of the female member, the male member being provided with a number of recesses arranged around an outer circumference of the male member, a resilient lock element being arranged in the groove, the resilient lock element comprising a protruding part being arranged in the through-going slit and extending through the through-going slit and into the through-going bore of the female member in order to be able to snap into one recess provided in the male member.

2. A coupling according to claim 1, wherein the protruding part of the resilient lock element comprises a bead or a bulge.

3. A coupling according to claim 1, wherein each of the number of recesses comprises sloping walls and an even bottom.

4. A coupling according to claim 1 or 3, wherein the number of recesses is displaced equally relative each other.

5. A coupling according to claim 1, wherein the female member is provided with at least one abutment shoulder around the circumference of the throughgoing bore, the at least one abutment shoulder cooperating with at least one abutment shoulder provided around the outer circumference of the male member.

6. A coupling member according to claim 5, wherein either abutment shoulder is arranged to be perpendicular on an axis extending through the throughgoing bore or form an angle relative the axis.

7. A coupling according to claim 6, wherein the male member is provided with an internal threaded area.

8. A coupling according to claim 6, wherein the male member over at least of a part of its longitudinal length is provided with a substantially triangular form exhibiting acute angles that are rounded.

9. A coupling according to claim 1, wherein the female member is provided with an external threaded portion.

10. A coupling according to claim 1, wherein the female member has a circular cross-section.

11. A coupling according to claim 1, wherein the male member is provided with a throughgoing bore.

12. A coupling according to claim 1 wherein the female member is an adapter or an attachment element.

13. A coupling according to claim 1, wherein the male member is a flame suppressor or a muzzle of a firearm.

* * * * *